US005967680A

United States Patent [19]

DeLorme

[11] Patent Number: 5,967,680

[45] Date of Patent: Oct. 19, 1999

[54] COMPACT PRINTER WITH CURVED SUPPLY TRAY

[75] Inventor: John D. DeLorme, Spencerport, N.Y.

[73] Assignee: Eastman Kodak Company, Rochester, N.Y.

[21] Appl. No.: 09/009,540

[22] Filed: Jan. 20, 1998

[51] Int. Cl.[6] ..... B41J 11/58

[52] U.S. Cl. ..... 400/624; 400/625; 400/208

[58] Field of Search ..... 400/624, 625, 400/208

[56] References Cited

U.S. PATENT DOCUMENTS

| | | | |
|---|---|---|---|
| 4,619,450 | 10/1986 | Anderson et al. | 271/161 |
| 4,822,186 | 4/1989 | Hanaoka et al. | 400/120 |
| 4,917,513 | 4/1990 | Takanashi et al. | 400/208 |
| 5,148,216 | 9/1992 | Park | 355/72 |
| 5,277,502 | 1/1994 | Kim | 400/196 |
| 5,421,570 | 6/1995 | Hube et al. | 271/145 |
| 5,615,959 | 4/1997 | Nishizawa et al. | 400/279 |

FOREIGN PATENT DOCUMENTS

| | | |
|---|---|---|
| 4-361923 | 12/1992 | Japan . |
| 5-213510 | 8/1993 | Japan . |
| 5-201553 | 10/1993 | Japan . |
| 6-141117 | 5/1994 | Japan . |
| 6-144680 | 5/1994 | Japan . |
| 2-291927 | 10/1994 | Japan . |
| 8-258299 | 10/1996 | Japan . |

*Primary Examiner*—Edgar Burr
*Assistant Examiner*—Daniel J. Colilla
*Attorney, Agent, or Firm*—Walter S. Stevens

[57] ABSTRACT

Compact printer with quick-loading cassette and method therefor. The invention includes a printer enclosure and a cassette insertable into the enclosure. The cassette includes a dye ribbon supply reel having a dye donor ribbon wound thereabout and a rotatable dye ribbon take-up reel engaging an end portion of the donor ribbon for taking-up the donor ribbon. A curved receiver supply tray is disposed in the cassette for supplying receiver sheets to the printhead which is disposed in the enclosure. The curved receiver supply tray occupies less space, depending on the radius of curvature, than the elongate rectangularly-shaped receiver supply trays of the prior art. Over time, a stack of the receiver sheets residing in the supply tray obtains a curved contour because the stack of receiver sheets conforms to the curved shape of the receiver supply tray. To avoid curling in the finished prints, a platen roller generates radiative heat which is applied to the receiver sheets in order to uncurl the receiver sheets during the printing process.

7 Claims, 2 Drawing Sheets

COMPACT PRINTER WITH CURVED SUPPLY TRAY

BACKGROUND OF THE INVENTION

This invention generally relates to printer apparatus and methods and more particularly relates to a compact printer with quick-loading cassette and method therefor, wherein the printer forms an image on a receiver sheet fed from the cassette and thereafter removes any curl present in the receiver sheet.

It is known that a typical thermal resistive printer includes a thermal resistive printhead capable of printing an image on a receiver medium, which may be cut sheets of paper or transparency. The receiver sheets are fed to the printhead by appropriate means and brought into contact with a dye donor ribbon. The printhead heat activates the dye donor ribbon to transfer dye to the receiver sheets in order to print an output image on the receiver sheets.

The possibility exists, however, that a user of the printer will inadvertently touch the dye donor ribbon when loading the dye donor ribbon into the printer. Touching the dye donor ribbon may damage the donor ribbon, such as by particulate matter and finger prints being deposited onto the donor ribbon. Of course, damage to the donor ribbon results in unacceptable artifacts appearing on the finished prints. In addition, the damaged donor ribbon may in turn damage the printhead. It is therefore desirable to avoid damaging the dye donor ribbon.

In addition, prior art printers necessarily require the donor ribbon and receiver medium be separately loaded into the printer. Separately loading the donor ribbon and receiver medium increases the time required to prepare the printer for producing prints. Therefore, it would be desirable to avoid separate loading of the donor ribbon and receiver medium.

Moreover, some printers require sheets of receiver medium to be individually hand-fed into the printer. However, hand-feeding receiver sheets into the printer may cause fouling of the receiver sheets (i.e., particulate matter and finger prints being deposited on the receiver sheets). It is therefore desirable to avoid hand-feeding individual receiver sheets into the printer.

A known technique to avoid hand-feeding individual receiver sheets is to provide a receiver sheet supply tray which holds a stacked-supply of the receiver sheets and which allows each receiver sheet to be mechanically fed into the printer. In this regard, receiver sheets are held in the receiver sheet supply tray, which is at least partially insertable into the printer, and mechanically supplied to the printhead housed in the printer. That is, a "picker" mechanism disposed in the printer engages the receiver sheets held in the supply tray and feeds individual receiver sheets to the printhead. Such a receiver sheet supply tray is of elongate rectangular shape to hold paper or transparency typically having dimensions of 8 inches wide by 11 inches long (i.e., "letter-size" sheets) or dimensions of 8.27 inches wide by 11.69 inches long (i.e., "A-4 size" sheets).

However, although use of the receiver sheet supply tray avoids hand-feeding individual receiver sheets, use of the supply tray is not entirely satisfactory where space conservation is a concern. That is, the elongate rectangular shape of the receiver supply tray results in a longer printer foot-print than would otherwise be the case because the length of the printer foot-print must accommodate the elongate shape of the receiver supply tray. It would therefore be desirable to reduce the size of the receiver supply tray in order to provide a compact printer while simultaneously accommodating "letter-size" or "A-4 size" receiver sheets.

One technique to reduce the size of the printer is to avoid use of an elongate receiver supply tray by providing a continuous roll of receiver tightly wound on a supply spindle mounted in a cassette, which is inserted into the printer. Use of the roll of receiver mounted in the cassette eliminates the need to use an elongate receiver supply tray and also may avoid fouling of the receiver. During the printing process, receiver continuously unwraps from about the receiver supply spindle to receive the image provided by the printhead. Sheets of the receiver are subsequently cut to size during the printing process to provide the desired print size, such as "letter-size" or "A-4 size" output.

Although use of a receiver roll reduces the printer exterior envelope by reducing its length, use the receiver roll can give rise to yet another problem. That is, use of the receiver roll can cause residual curl in the finished print, which is a highly undesirable result. Such residual curl is due to the receiver having been wound in a roll around the receiver supply spindle. Indeed, prints made from the receiver closest to the inner diameter of the receiver supply spindle exhibit the most curl in the finished print because the receiver is more tightly wound closest to the inner diameter of the receiver supply spindle.

Hence, prior art attempts to provide a compact printer and artifactfree prints by using a cassette-mounted roll of receiver rather than a receiver supply tray have resulted in finished prints with residual curl therein. Therefore, it would be desirable to provide a compact printer which does not produce curl in the finished print. It would also be desirable to avoid separate loading of the donor ribbon and receiver medium in order to save loading time.

Therefore, there has been a long-felt need to provide a compact printer with quick-loading cassette and method therefor, wherein the printer forms an image on a receiver sheet fed from the cassette and thereafter removes any curl present in the receiver sheet.

SUMMARY OF THE INVENTION

The invention resides in a compact printer comprising an enclosure and a curved receiver supply tray insertable into the enclosure. The supply tray is curved so that the enclosure and said supply tray together conserve space as the supply tray is inserted into the enclosure.

More specifically, the invention is a compact printer for forming an image on cut sheets of receiver, which may have a curl induced therein, and for thereafter removing the curl after the image is formed. In this regard, the invention includes a printer enclosure and a cassette insertable into the enclosure. A platen roller is provided in the enclosure for supporting the cut sheets of receiver during printing. Also disposed in the enclosure is a thermal resistive printhead which generates radiative heat used in the printing process.

A cassette is also provided that is capable of being slidably inserted into the enclosure. The cassette includes a freely-rotatable dye ribbon supply reel having a dye donor ribbon wound thereabout. A rotatable dye ribbon take-up reel engaging an end portion of the donor ribbon is also disposed in the cassette for taking-up the donor ribbon. A curved (i.e., curvilinear) receiver supply tray is disposed in the cassette for supplying the receiver sheets to the printhead which in turn generates the radiative heat for transferring dye from the donor ribbon to the receiver sheet. The curved receiver supply tray occupies less space, depending on the radius of curvature, than the elongate rectangularly-shaped receiver supply trays of the prior art. Moreover, the printer can be quickly loaded with receiver and donor ribbon because both the receiver and donor ribbon are contained in the cassette, which is easily inserted into the printer.

The stack of the receiver sheets residing in the supply tray therefore obtains a curved or curled contour because the stack of receiver sheets conforms to the curved shape of the receiver supply tray. Over time, the initially flat receiver sheets will assume the curved contour presented by the curved receiver supply tray. To straighten the receiver sheets, the platen roller applies radiative heat to the receiver sheets for removing any curl which may have preset into the receiver sheets due to the receiver sheets having rested for a time in the curved receiver supply tray. That is, the platen roller is capable of generating radiative heat which is applied to the receiver sheets in order to uncurl the receiver sheets. The heat applied by the heated platen roller acts to relax any such curled receiver sheets, so that the curled receiver sheets tend to uncurl and straighten during the printing process.

An object of the present invention is to provide a compact printer with quick-loading cassette and method therefor, wherein the printer forms an image on a receiver sheet fed from the cassette and thereafter removes any curl present in the receiver sheet.

A feature of the present invention is the provision of a curved receiver sheet supply tray insertable into a printer enclosure belonging to the printer, the supply tray being curved for providing a printer occupying less space.

An advantage of the present invention is that it affords a compact printer.

Another advantage of the present invention is that use thereof removes any curl present in the receiver sheets.

Yet another advantage of the present invention is that a cassette associated therewith is quick-loading.

Still another advantage of the present invention is that fouling of the receiver sheets is avoided.

A further advantage of the present invention is that damage to the dye donor ribbon is avoided.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DESCRIPTION OF PREFERRED EMBODIMENTS OF THE INVENTION

Figure 1:
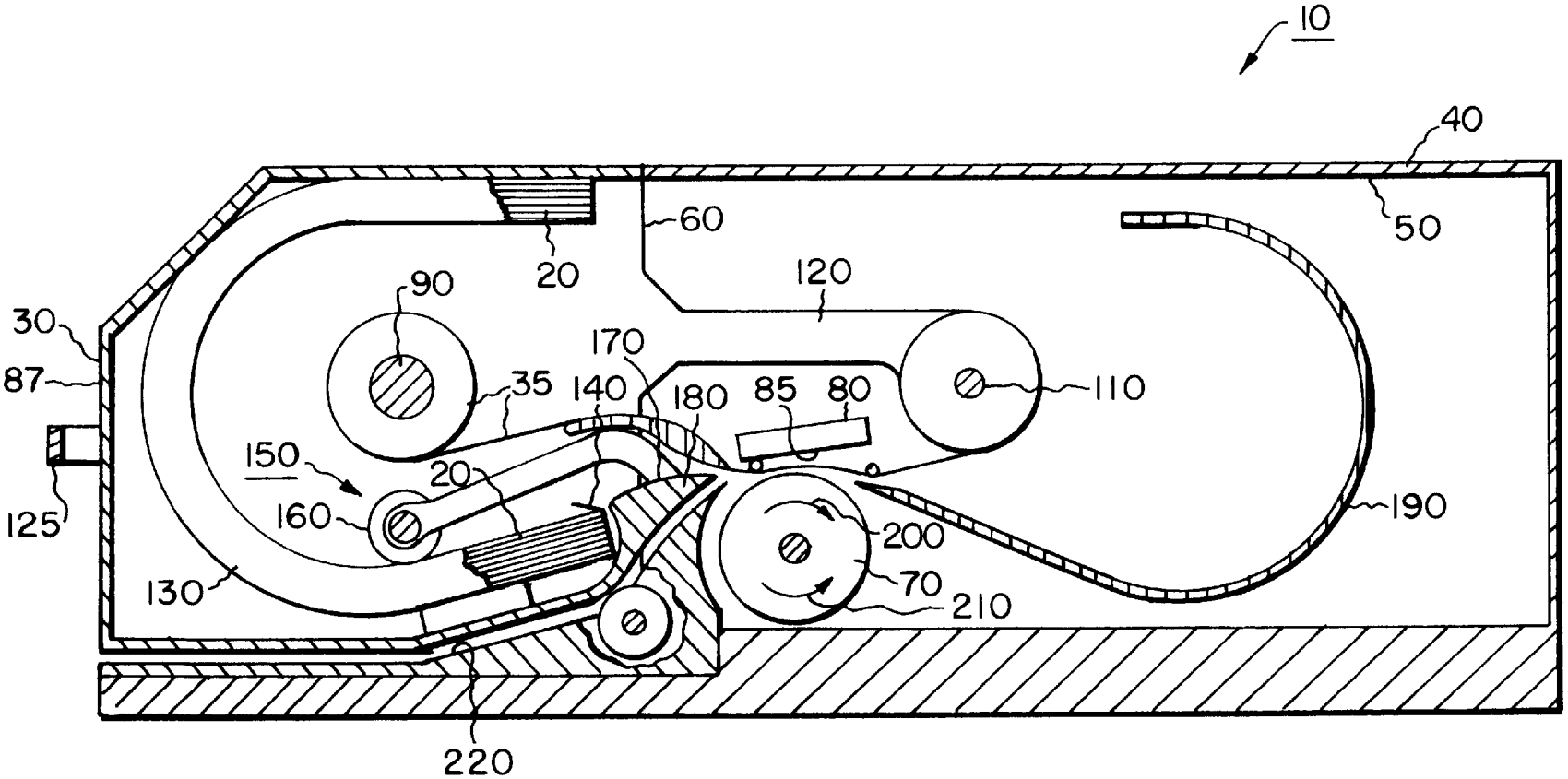
FIG. 1 is a view in partial vertical section of a compact printer belonging to the invention.
Figure 2:
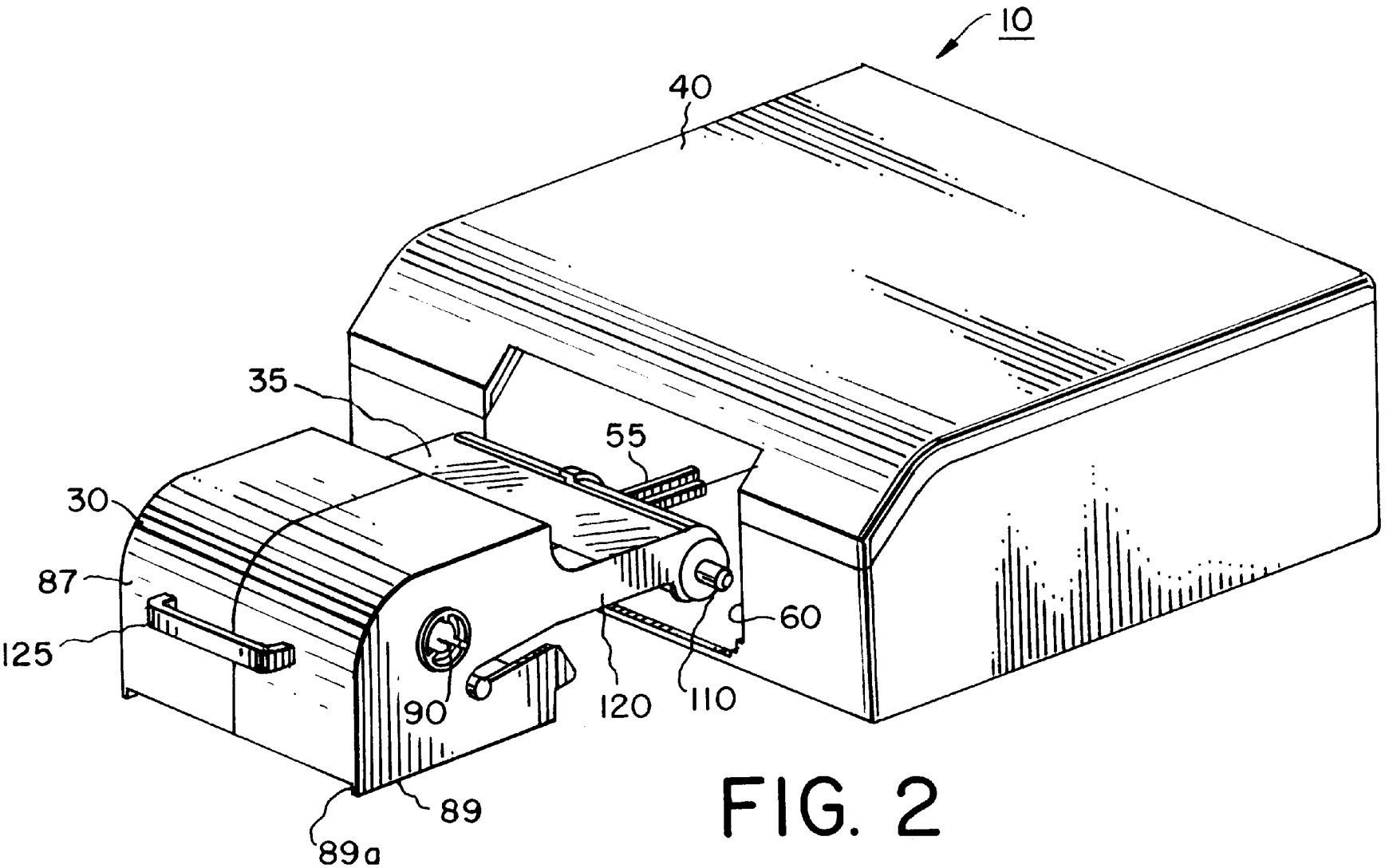
FIG. 2 is a view in perspective of a combined donor ribbon and receiver supply cassette usable with the compact printer.

Referring to FIGS. 1 and 2, there is shown a compact printer, generally referred to as 10, for forming an image on a receiver 20, which may be cut sheets of paper or transparency. As described more fully hereinbelow, receiver 20 is contained in a removable cassette 30, which also contains a dye donor ribbon 35.

Referring again to FIGS. 1 and 2, printer 10 comprises an enclosure 40 defining an interior 50 therein for enclosing components belonging to printer 10. Enclosure 40 also includes a pair of oppositely disposed guide rails 55 for reasons disclosed hereinbelow. Moreover, formed in a sidewall of enclosure 40. is an aperture 60 for reasons described hereinbelow. In addition, enclosed in enclosure 40 is a support member, such as a platen roller 70, for supporting receiver 20 thereon. For reasons disclosed hereinbelow, platen roller 70 is capable of generating radiative heat which is applied to receiver 20. Also disposed in interior 50 and adjacent to platen roller 70 is a movable thermal resistive printhead 80 which includes a plurality of thermal resistive heating elements (not shown). The thermal resistive heating elements generate radiative heat used in the printing process to produce the image on receiver 20, as described hereinbelow. Platen roller 70 and printhead 80 define a nip (i.e., gap) 85 therebetween sized to accept receiver 20 therethrough. For reasons provided hereinbelow, movable printhead 80 is capable of moving from a first position thereof spaced-apart from receiver 20 to a second position into engagement with receiver 20.

Referring yet again to FIGS. 1 and 2, previously mentioned cassette 30 includes a cassette body 87 having a lower edge portion 89 formed with a recess 89*a* extending therealong to be slidably received along guide rails 55. In this manner, cassette body 87 is capable of being slidably inserted through aperture 60 and into enclosure 40 along guide rails 55. Connected to cassette body 87 is a freely-rotatable dye ribbon supply reel 90 having dye donor ribbon 35 wound thereabout. A rotatable dye ribbon take-up reel 110 engaging an end portion of ribbon 35 is also connected to cassette body 87 and spaced-apart from donor ribbon supply reel 90 for taking-up ribbon 35. In this regard, take-up reel 110 is spaced-apart from supply reel 90, such as by means of an outwardly-extending arm 120 belonging to cassette body 87. Take-up reel 110 may be motorized such that ribbon 35 traverses through nip 85 as take-up reel 110 rotates and pulls ribbon 70 from supply reel 90. Cassette body 87 may further include a handle 125 for maneuvering cassette 30 into and out of aperture 60 along guide rails 55.

As best seen in FIG. 1, previously mentioned movable printhead 80 is capable of moving from the first position to the second position thereof for substantially closing nip 85. As nip 85 substantially closes, platen roller 70 is caused to rotate and engage receiver sheet 20, so that receiver sheet 20 passes through nip 85. In addition, as nip 85 closes, donor ribbon 35 also passes through nip 85 as donor ribbon 35 is taken-up onto take-up reel 110. As both donor ribbon 35 and receiver 20 simultaneously pass through nip 85, the heating elements of printhead 80 are actuated, in a manner well known in the art, so that dye transfers from donor ribbon 35 to receiver 20. In this regard, donor ribbon 35 may comprise a plurality of sequentially repeating groups of color patches (e.g., cyan, magenta, and yellow patches in each group) for printing color images on receiver 20. In this case, receiver 20 is alternately advanced and retracted through nip 85 to successively print color planes on receiver 20 by sequentially applying dye from each group of the color patches. In this manner, full-color images are formed on receiver 20.

Still referring to FIG. 1, a curved (i.e., curvilinear) receiver supply tray 130 of predetermined radius is disposed in cassette body 110 for holding a supply of receiver sheets 20. It is important that receiver supply tray 130 be curved. This is important because curved receiver supply tray 130 occupies less space, depending on the radius of curvature, than the elongate rectangularly-shaped receiver supply trays of the prior art. In this regard, receiver supply tray 130 preferably has a generally semi-circular or arcuate-shaped transverse cross-section cradling a stack of the receiver sheets 20. The stack of receiver sheets 20 therefore obtains a curved or curled contour within curved receiver supply tray 130 because the stack of receiver sheets 20 conforms to the semi-circular or curved shape of receiver supply tray 130. Over time, the initially flat receiver sheets 20 will assume the curved contour presented by curved receiver supply tray 130, which curved contour is removed in a manner described in more detail hereinbelow. Receiver supply tray 130 preferably includes a pair of separation pawls 140 (only one of which is shown) integrally attached thereto for separating each receiver sheet 20 from the stack of receiver sheets as each receiver sheet 20 is fed from the stack of receiver sheets in the manner described immediately hereinbelow.

Therefore, referring again to FIG. 1, a picker mechanism, generally referred to as 150, having a rotatable motorized picker roller 160 is disposed in interior 50 for feeding each receiver sheet 20 from the stack of receiver sheets. That is, picker mechanism 150 is disposed in interior 50 in such a manner that it is interposed between printhead 50 and supply tray 130 for picking individual sheets 20 of receiver 20 from supply tray 130 and thereafter feeding those individual receiver sheets into nip 85. As individual sheets 20 are fed from supply tray 130 and into nip 85, sheets 20 will slide along a guide surface 170 defined by a guide ramp 180 interposed between receiver supply tray 130 and platen roller 70. In this regard, movable picker roller 160 is capable of moving from a first position spaced-apart from receiver supply tray 130 to a second position adjacent to receiver supply tray 130 as receiver supply tray 130 is received into enclosure 40. When motorized picker roller 160 moves to the second position thereof, picker roller 160 engages the top-most receiver sheet 20 and then rotates to feed the top-most receiver sheet 20 from receiver supply tray 130 and into nip 85. As the top-most receiver sheet 20 is fed from receiver supply tray 130, a leading edge of top-most receiver sheet 20 engages separation pawl 140 to ensure that a single receiver sheet 20 separates from the stack of receiver sheets 20 and feeds into nip 85. Each receiver sheet 20 is thereafter supported by platen roller 70 as each receiver sheet 20 is fed into nip 85. As previously mentioned, platen roller 70 is capable of applying radiative heat to receiver sheets 20 for removing any curl which may have preset into receiver sheets 20 due to receiver sheets 20 having rested in semi-circular shaped receiver supply tray 130. In this regard, the heat applied by heated platen roller 70 acts to relax any such curled receiver sheets 20, so that curled receiver sheets 20 tend to uncurl and straighten. Alternatively, waste heat from the thermal resistive heaters comprising thermal resistive printhead 80 may be harvested and directed to each receiver sheet 20, such as by means of a suitable blower (not shown) associated with printhead 80, for applying convective waste heat to each receiver sheet 20 in order to relax any residual curl in receiver sheet 20. In addition, it may be appreciated that the amount of radiative heat applied by platen roller 70 and/or convective heat supplied from printhead 80 may be selected so as to fuse the image into receiver 20 after printhead 80 forms the image on receiver sheet 20. Alternatively, it may be appreciated that in the particular case where donor ribbon 35 includes a laminate patch (not shown) which is heat adhered to each receiver sheet 20 for protecting the finished image on each receiver sheet 20, the heat induced during the lamination process may be sufficient to remove curl from receiver sheet 20.

Still referring to FIG. 1, a receiver sheet catch 190 is provided in interior 50 adjacent to platen roller 70 for catching each receiver sheet 20 as each receiver sheet 20 passes through nip 85. In this regard, catch 190 has a semi-circular or arcuate-shaped transverse cross section rather than an elongate configuration. It is important that catch 190 have a semi-circular or arcuate-shaped transverse cross section. This is important in order that catch 190 conserves space when disposed within interior 50. Conserving space within interior 50 enhances the compactness of printer 10. It may be appreciated that catch 190 catches and temporarily holds individual receiver sheets 20 as each receiver sheet 20 alternately passes back-and-forth through nip 85. This occurs each time a color plane (e.g., yellow, magenta, and cyan color plane) is laid-down onto receiver sheet 20 during color printing. To achieve this result, platen roller 70 can be rotated in a forward direction illustrated by a forward arrow 200 in order to advance receiver sheet 20 from nip 85 and into catch 190. Similarly, platen roller 70 can be rotated in a backward direction illustrated by a backward arrow 210 in order to retract receiver sheet 20 from catch 190 and through nip 85. When all color planes have been laid-down by printhead 80, platen roller 70 again rotates a predetermined amount in the backward direction illustrated by backward arrow 210, so that receiver sheet 20 passes through a passage 220 and out enclosure 40 for retrieval by an operator of printer 10.

It is understood from the description hereinabove that an advantage of the present invention is that it affords a compact printer. This is so because the size or "foot-print" of printer 10 is reduced compared to prior art devices due to the semi-circular or arcuate-shaped configuration of the receiver supply tray 130 and receiver catch 190. That is, the semi-circular or arcuate-shaped configuration of the receiver supply tray 130 and the receiver catch 190 occupies less space (i.e., less volume) compared to an elongate supply tray and catch.

Another advantage of the present invention is that use thereof removes any curl present in receiver sheets 20. Although use of curved receiver supply tray 130 may induce curl in receiver sheets 20, the curl is removed by applying heat from platen roller 70 or waste heat from printhead 80.

Yet another advantage of the present invention is that it is quick-loading. This is so because the receiver sheet supply tray 130, donor ribbon supply reel 110 and donor ribbon take-up reel 110 are contained within cassette 30, which can be quickly and easily inserted and retrieved from enclosure 40. That is, cassette 30, which contains both receiver sheets 20 and donor ribbon 35, may be quickly and easily inserted into and retrieved from enclosure 40 by grappling handle 125 and sliding recess 89*a* along guide rails 55.

Still another advantage of the present invention is that fouling of the receiver sheets is avoided. This is so because receiver sheets 20 are mechanically fed rather than individually hand-fed into printer 10.

A further advantage of the present invention is that damage to the dye donor ribbon is avoided. This is so because cassette 30 containing donor ribbon 35 can be easily inserted into and retrieved from printer enclosure 40 merely by use of handle 125. Therefore, donor ribbon 35 need not by touched.

The invention has been described in detail with particular reference to certain preferred embodiments thereof, but it will be understood that variations and modifications can be effected within the spirit and scope of the invention. For example, although the present invention has been described in the context of use in a thermal resistive printer, the present invention is also applicable for use in other types of printers, such as inkjet printers, whenever it is desired to use a curved receiver supply tray and whenever the application of heat is needed to uncurl curled receiver sheets. As another example, although receiver supply tray 130 is described as having a semi-circular or arcuate shape, receiver supply tray 130 and the stack of receiver sheets 20 held therein may be alternatively tightly coiled in a spiral-type configuration to further conserve space in interior 50. As yet another example, arm 120 may be configured so that it is slidably adjustable. That is, in such an alternative configuration, arm 120 can be designed so that it is outwardly extendible to bring take-up reel 110 to the operative position shown and inwardly retractable in a reverse direction to a non-operative position such that take-up reel 110 is closer to donor ribbon supply reel 90. When arm 120 is retracted in this manner, cassette 30 saves space during shipment.

Moreover, as is evident from the foregoing description, certain other aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

Therefore, what is provided is a compact printer with quick-loading cassette and method therefor, wherein the printer forms an image on a receiver sheet fed from the cassette and thereafter removes any curl present in the receiver sheet.

What is claimed is:

1. A printer for forming an image on a receiver sheet, comprising:

(a) an enclosure defining an aperture therein;

(b) a rotatable platen roller disposed in said enclosure for supporting the receiver sheet thereon;

(c) a cassette body insertable through the aperture and into said enclosure;

(d) a thermal resistive printhead disposed adjacent to said platen roller so as to define a gap therebetween;

(e) a thermal dye donor ribbon supply reel connected to said cassette body for supplying dye donor ribbon into the gap defined between said platen roller and said printhead;

(f) a thermal dye donor ribbon take-up reel connected to said cassette body and spaced-apart from said donor ribbon supply reel for taking-up the dye donor ribbon;

(g) a receiver supply tray disposed in said cassette body and capable of having the receiver sheet reside therein for supplying the receiver from said supply tray and into the gap defined between said platen roller and said printhead, said supply tray having an arcuate-shaped transverse cross-section inducing a curl in the receiver sheet, whereby said enclosure and said supply tray conserve space as said supply tray is disposed entirely within said enclosure; and (h) a receiver catch disposed in said enclosure and having an arcuate-shaped transverse cross-section for holding the receiver sheet as the receiver sheet is supplied from the gap, whereby said enclosure, said supply tray and said catch conserve space as said curved supply tray and said curved catch are disposed within said enclosure.

2. The printer of claim 1, wherein said platen roller is heated for applying radiative heat to the receiver for uncurling the receiver.

3. The printer of claim 1, wherein said platen roller is heated for applying radiative heat to the receiver for fusing the image into the receiver after the image forms on the receiver.

4. For use in a printer, a cassette, comprising:

(a) a cassette body;

(b) a dye donor ribbon supply reel connected to said cassette body, said supply reel having a dye donor ribbon wound thereabout;

(c) a dye donor ribbon take-up reel connected to said cassette body for taking-up the donor ribbon; and (d) a curved receiver supply tray disposed in the cassette body, said supply tray having a receiver sheet residing therein for supplying the receiver sheet from the supply tray.

5. The cassette of claim 4, wherein said supply tray has an arcuate-shaped transverse cross-section.

6. In a printer, a method of providing a cassette, comprising the steps of:

(a) connecting a dye donor ribbon supply reel to a cassette body, the supply reel having a dye donor ribbon wound thereabout;

(b) connecting a dye donor ribbon take-up reel to the cassette body for taking-up the donor ribbon; and (c) disposing a curved receiver supply tray into the cassette body, the supply tray capable of having a receiver sheet reside therein for supplying the receiver sheet from the supply tray.

7. The method of claim 6, wherein the step of disposing a supply tray into the cassette body comprises the step of disposing a supply tray into the cassette having an arcuate-shaped transverse cross-section.

* * * * *